US010240854B2

(12) United States Patent
Jung et al.

(10) Patent No.: US 10,240,854 B2
(45) **Date of Patent: *Mar. 26, 2019**

(54) REFRIGERATOR

(71) Applicant: LG ELECTRONICS INC., Seoul (KR)

(72) Inventors: Yongki Jung, Seoul (KR); Chanju Pae, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/465,721

(22) Filed: Mar. 22, 2017

(65) Prior Publication Data

US 2017/0276423 A1 Sep. 28, 2017

(30) Foreign Application Priority Data

Mar. 23, 2016 (KR) ..... 10-2016-0034969

(51) Int. Cl.
*F25D 23/02* (2006.01)
*F25D 23/04* (2006.01)
(Continued)

(52) U.S. Cl.
CPC ..... *F25D 23/028* (2013.01); *F25D 11/02* (2013.01); *F25D 23/02* (2013.01); *F25D 23/04* (2013.01);
(Continued)

(58) Field of Classification Search
CPC ..... A47B 88/95; A47B 2088/951; A47B 2210/175; A47B 57/10; A47B 57/32;
(Continued)

(56) References Cited

U.S. PATENT DOCUMENTS 3,709,576 A * 1/1973 Lemoine ..... F25D 23/04 211/90.03
4,859,010 A * 8/1989 Jeziorowski ..... A47B 57/10 312/138.1
(Continued)

FOREIGN PATENT DOCUMENTS

DE 102012008596 * 10/2013
EP 2220446 8/2010
(Continued)

OTHER PUBLICATIONS

Extended European Search Report in European Application No. 17161810.1, dated Aug. 21, 2017, 9 pages (with English translation).

*Primary Examiner* — Janet M Wilkens
(74) *Attorney, Agent, or Firm* — Fish & Richardson P.C.

(57) ABSTRACT

A refrigerator includes: a cabinet having a storage space formed therein; a door mounted to the cabinet to open/close the storage space; a mounting projection formed at a rear surface of the door; and a door basket attachably/detachably mounted at the rear surface of the door by the mounting projection, wherein the door basket includes: a storage part formed of a transparent material to allow the inside thereof to be seen, the storage part forming a space in which foods are stored; and a frame part formed at a bottom end of the storage part, the frame part being coupled to the mounting projection to support the door basket and simultaneously shield the mounting projection at the outside.

18 Claims, 13 Drawing Sheets

(51) Int. Cl.
*F25D 11/02* (2006.01)
*F25D 25/02* (2006.01)
*A47B 96/06* (2006.01)

(52) U.S. Cl.
CPC ..... *F25D 25/022* (2013.01); *A47B 96/06* (2013.01); *F25D 2323/021* (2013.01); *F25D 2323/023* (2013.01)

(58) Field of Classification Search
CPC ..... F25D 25/025; F25D 23/028; F25D 23/04; F25D 23/025; F25D 23/022; F25D 23/067; F25D 11/02
USPC ..... 312/402, 404, 408, 330.1, 321.5, 405.1
See application file for complete search history.

(56) References Cited

U.S. PATENT DOCUMENTS 4,921,315 A * 5/1990 Metcalfe ..... A47B 96/16 312/321.5
5,004,305 A * 4/1991 Montuoro ..... F25D 23/04 312/350
5,346,299 A * 9/1994 Werkmeister ..... F25D 23/04 312/405.1
5,375,924 A * 12/1994 Pohl ..... A47B 57/10 108/109
5,951,134 A 9/1999 Braun et al.
6,908,163 B1 * 6/2005 Hebeler ..... F25D 23/04 312/321.5
9,816,746 B1 * 11/2017 Haney ..... F25D 23/028
2006/0082270 A1 4/2006 Collins et al.
2017/0191739 A1 * 7/2017 Jung ..... A47B 96/06
2017/0191741 A1 * 7/2017 Jung ..... F25D 23/04
2017/0350642 A1 * 12/2017 Yang ..... F25D 25/025

FOREIGN PATENT DOCUMENTS

EP 2594874 5/2013
EP 2770285 8/2014
EP 3190369 7/2017
KR 1020100046360 * 5/2010
KR 10-20102-0006723 1/2012
WO 2016060456 * 10/2015
WO 2016129944 * 8/2016

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2016-0034969 filed Mar. 23, 2016, which is hereby incorporated by reference in its entirety.

BACKGROUND

The present disclosure relates to a refrigerator.

In general, a refrigerator is a home appliance that can store foods at a low temperature in an internal storage space shield by a door. The refrigerator cools the inside of the storage space using cool air generated through heat exchanging with a refrigerant that circulates a refrigerating cycle, to store the foods in an optimum state.

Such refrigerators tend to increase in size and to have multiple functions in response to changes in eating habits and tastes of users, and refrigerators having various structures and convenient devices for user convenience and freshness of foods are being placed on the market.

In particular, as the storage capacity of the refrigerator increases, the capacity of a door basket that forms a storage space at a rear surface of the door of the refrigerator also increases. Accordingly, there has been developed a refrigerator for providing a stable fixed structure.

In addition, there has been developed a refrigerator in which a door basket becomes transparent to further improve the appearance thereof and to enable a user to easily check foods stored therein.

Meanwhile, in a typical refrigerator having such a structure, when a door basket becomes transparent so as to allow a user to check foods stored therein, a mounting part to which the door basket is coupled at an inner surface of a door is exposed through the door basket, and therefore, the appearance of the door basket is not good.

In addition, when the capacity of the door basket increases, the mounting stability of the door basket is lowered, and therefore, the door basket may be arbitrarily separated when the door is opened.

SUMMARY

Embodiments provide a refrigerator in which, when a door basket having a transparent appearance is mounted, a coupling part of the door basket to a door is not exposed, so that the appearance of the door basket can be further improved.

Embodiments also provide a refrigerator in which a door basket can maintain a stable mounting state even in an increase in storage load and in a rotating operation of a door.

In one embodiment, a refrigerator includes: a cabinet having a storage space formed therein; a door mounted to the cabinet to open/close the storage space; a mounting projection formed at a rear surface of the door; and a door basket attachably/detachably mounted at the rear surface of the door by the mounting projection, wherein the door basket includes: a storage part formed of a transparent material to allow the inside thereof to be seen, the storage part forming a space in which foods are stored; and a frame part formed at a bottom end of the storage part, the frame part being coupled to the mounting projection to support the door basket and simultaneously shield the mounting projection at the outside.

The frame part may be formed of an opaque material, and be mounted at a bottom surface of the storage part.

The frame part may allow the bottom end of the storage part to be opaque through any one of metal deposition, painting, printing, and coating.

The mounting projection may be integrally formed in molding of a door liner that forms the rear surface of the door.

The mounting projection may include: side surface parts respectively formed at inner surfaces of door dikes protruding at both edges of the rear surface of the door; and a rear surface part connecting between both the side surface parts.

A supporting rib that protrudes rearward and is held and restricted to a bottom end of the rear surface part may be formed at a rear surface of the door basket.

The mounting projection may be formed at each of the door dikes protruding at both left and right sides of the door, and extend in a direction horizontal to a bottom surface of the door basket.

The frame part may include: mounting parts respectively extending downward at both side surfaces of the frame part corresponding to positions of inner surfaces of the mounting projection to cover the mounting projection in the lateral direction; and a top surface extending outward at a top end of the mounting part to be mounted on a top surface of the mounting projection.

An inclined surface may be formed at the front end of the mounting projection such that a thickness of the mounting projection is thickened as approaching the rear end of the mounting projection. A fixing groove recessed or penetrated in the top-bottom direction may be formed at the rear of the inclined surface.

A guide groove opened rearward such that the mounting projection is inserted thereinto may be formed in the frame part. An elastic part that is elastically deformed in the top-bottom direction while being in contact with the mounting projection in the insertion of the mounting projection may be formed at a bottom surface of the guide groove.

The fixing projection extending downward may be formed above the elastic part, and a gap between the fixing projection and the elastic part may be formed narrower than the thickness of the mounting projection. The fixing projection may be formed at a position at which the fixing groove is inserted in a state in which the door basket is mounted.

Each of the fixing projection and the fixing groove may be formed in plurality spaced apart from each other in an insertion direction of the door basket.

Mounting parts extending downward to cover the mounting projection in the lateral direction may be formed at both side surfaces of the frame part, respectively. A slit may be formed between the mounting part and the elastic part to facilitate elastic deformation of the elastic part.

The elastic part may include: an inclination part connected to the frame part, the inclination part having an inclination corresponding to the inclined surface; an extension part extending from the inclination part, the extension part being in contact with a bottom surface of the mounting projection; and an entrance part extending from the extension part to form a spacing space with the fixing projection. The spacing space may be greater than a thickness of the front end of the inclined surface and smaller than a thickness of the rear end of the inclined surface.

The elastic part may extend rearward of the fixing projection, and be formed with a vertical gap narrower than the thickness of the mounting projection to press-fix the mounting projection in the mounting of the door basket.

A rim extending to accommodate the frame part may be formed along the circumference of the bottom end of the storage part.

A fixing projection coupled to the mounting projection may be formed at the frame part, and a mounting part may be formed to cover the mounting projection. A cut-out part opened in a shape corresponding to the region of the mounting part may be formed at the rim corresponding to the mounting part.

The frame part may include: an inner part formed in the shape of a quadrangular frame; a rib-shaped outer part spaced apart from the inner part, the outer part being in contact with the rim; and a rib-shaped inner part spaced apart from the outer part. Top ends of the outer and inner parts may be connected to each other, and be in contact with the bottom surface of the storage part.

A restricting rib protruding to be in contact with an inner surface of the inner part may be formed at the bottom surface of the storage part. A restricting projection protruding to be in contact with a bottom end of the outer part may be formed at the inside of the rim to restrict the frame part.

A mounting part that is coupled to the mounting projection and shields the mounting projection may be formed at the inner part. A portion of the outer part, which corresponds to the mounting part, may be cut out such that the mounting projection enters therethrough in the mounting of the door basket.

The refrigerator according to the present disclosure has advantageous effects as follows.

According to the present disclosure, a mounting projection for mounting a door basket is coupled to a frame part of the door basket to support the door basket. Thus, although a storage part is formed transparent, the mounting projection is covered by the frame part, so that a configuration for coupling is not exposed, thereby further improving the appearance of the door basket.

Further, as the door basket is formed with a transparent storage part and a firm frame part, each of the storage part and the frame part can be molded with a material suitable for characteristics thereof. Thus, the utility of the door basket can be improved, and a more firm structure can be provided.

Further, as the mounting projection extends horizontally to the bottom surface of the door basket, the door basket can be more effectively supported. Thus, a stable mounting structure even when the capacity of the door basket is increased or when a temporarily high load is applied.

Further, a plurality of fixing groove spaced apart from one another in the front-rear direction in which the door basket is extracted are formed at the mounting projection, and fixing projections of the frame part are restricted in the plurality of fixing grooves. Thus, although the capacity of the door basket increases, a stable mounting and fixing structure can be provided.

Further, the mounting projection includes side surface parts formed at the inner surface of a door dike and a rear surface part connecting the side surface parts, and both side surfaces and a rear surface are supported by the structure of a mounting part of the frame part and the structure of a supporting rib of the storage part. Thus, a load of the door basket is dispersed to the frame part and the storage part, so that a mounting state of the door basket can be more stably and firmly maintained.

Further, although a horizontal extending structure of the mounting projection is provided, the door basket can be easily attached/detached due to the structure of the elastic part, the fixing projections, and the fixing grooves, and it is possible to prevent the door basket from be arbitrarily separated due to rotation of the door, thereby further improving user's convenience and stability.

DETAILED DESCRIPTION OF THE EMBODIMENTS

Hereinafter, exemplary embodiments of the present disclosure will be described in detail with reference to the accompanying drawings. However, the spirit of the present disclosure is not limited to the suggested embodiments, but those skilled in the art to which the present disclosure pertains can suggest another retrogressive invention or another embodiment which falls within the spirit of the present disclosure through addition, modification, and deletion of another component without departing from the spirit of the present disclosure.

Figure 1:
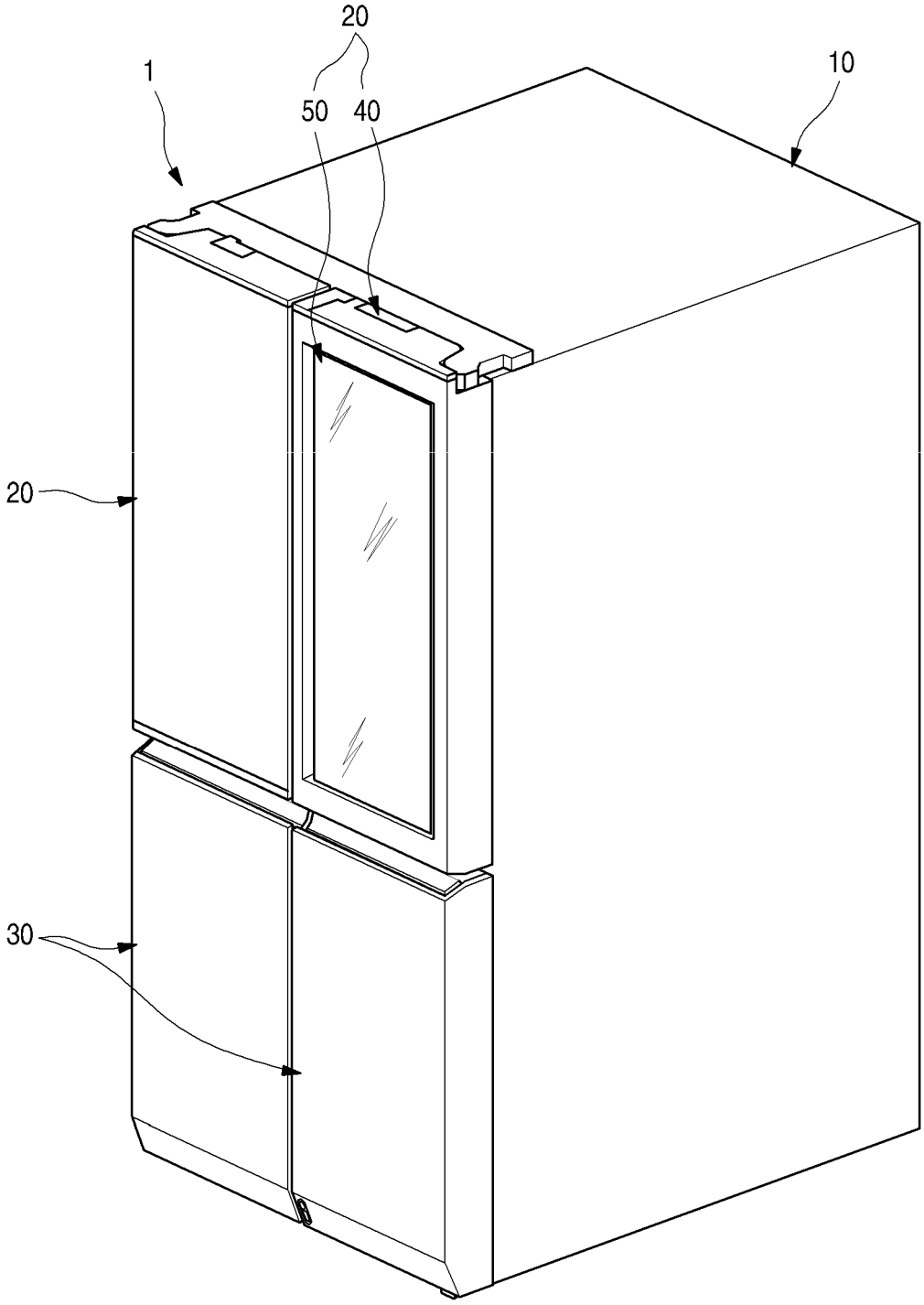
FIG. 1 is a perspective view of a refrigerator according to an embodiment.
Figure 2:
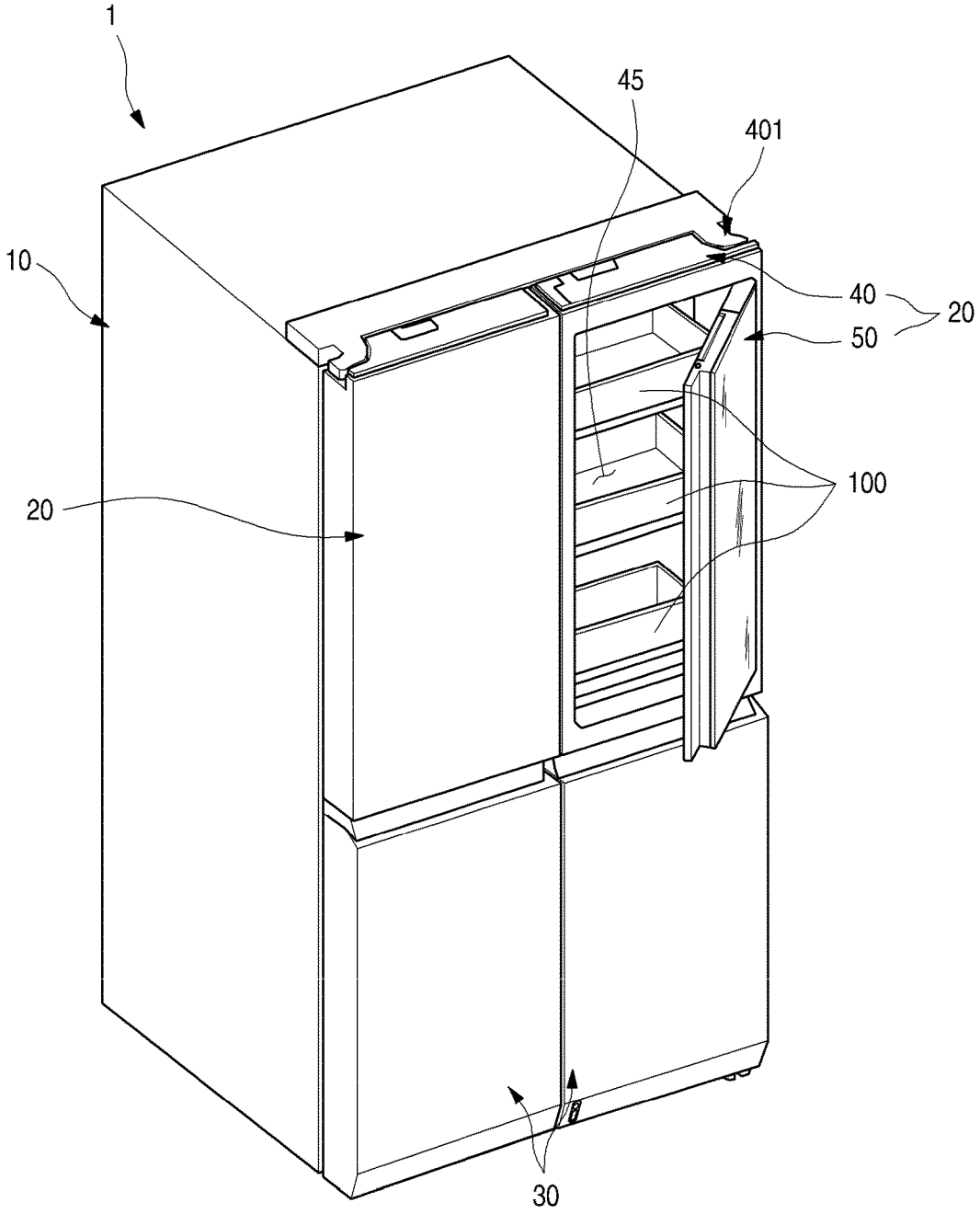
FIG. 2 is a perspective view when a sub-door of the refrigerator is opened.
Figure 3:
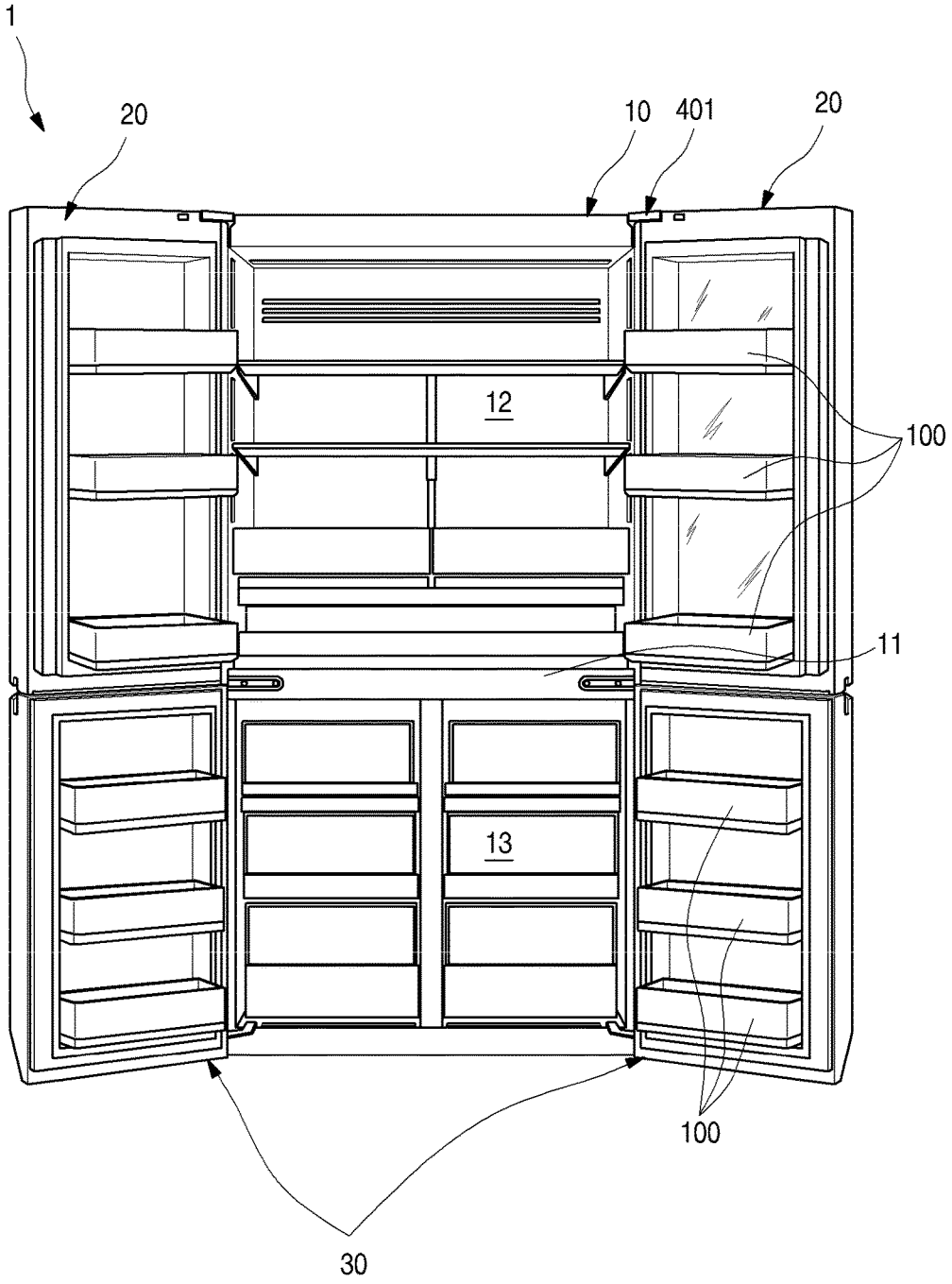
FIG. 3 is a front view when all doors of the refrigerator are opened.

FIG. 1 is a perspective view of a refrigerator according to an embodiment. FIG. 2 is a perspective view when a sub-door of the refrigerator is opened. FIG. 3 is a front view when all doors of the refrigerator are opened.

As shown in the drawings, an appearance of the refrigerator 1 according to the embodiment may be formed by a cabinet 10 that forms a storage space and a door that opens/closes the storage space of the cabinet 10.

The inside of the cabinet 10 may be vertically divided by a barrier 11. A refrigerating compartment 12 may be formed at an upper portion of the cabinet 10, and a freezing compartment 13 may be formed at a lower portion of the cabinet 10.

In addition, various storage members such as shelves, drawers, and baskets may be provided in the refrigerating compartment 12 and the freezing compartment 13. If necessary, the storage members may move forward/backward in a state in which the door is opened, and foods may be stored as the storage members move forward/backward.

The door may include a refrigerating compartment door 20 and a freezing compartment door 30. The refrigerating compartment door 20 may open/close an opened front surface of the refrigerating compartment 12 by rotation thereof, and the freezing compartment door 30 may open/close an opened front surface of the freezing compartment 13 by rotation thereof. In addition, the refrigerating compartment door 20 may be provided with a pair of left and right doors to shield the refrigerating compartment 12, and the freezing compartment door 30 may be provided with a pair of left and right doors to shield the freezing compartment 13.

A plurality of door baskets 100 may be provided in the refrigerating compartment door 20 and the freezing compartment door 30. The door baskets 100 may be configured not to interfere with storage members provided in the refrigerator 1 in a state in which the refrigerating compartment door 20 and the freezing compartment door 30 are closed.

Meanwhile, in the embodiment, the refrigerator in which a French type door having a pair of door rotated to open/close one space is applied to a bottom freeze type refrigerator having a freezing compartment provided at a lower portion thereof is described as an example. However, the present disclosure is not limited to types of refrigerators and may be applied to all types of refrigerators having doors to which door baskets are mountable.

When viewed from the front, the refrigerating compartment door 20 and the freezing compartment door 30 form the entire appearance. The appearance may be formed of a metallic material, so that the entire refrigerator 1 has the texture of the metallic material. In addition, a dispenser for allowing a user to take out water or ice, if necessary.

Meanwhile, the right door (when viewed in FIG. 1) out of the pair of refrigerating compartment doors 20 may be configured to be opened/closed doubly. In detail, the refrigerating compartment door 20 located at the right side may include a main door 40 formed of a metallic material to open/close the refrigerating compartment 12, and a sub-door 50 rotatably disposed at the inside of the main door 40 to open/close an opening of the main door 40.

The main door 40 may be formed in the same size as the left refrigerating compartment door 20 (when viewed in FIG. 1) out of the pair of refrigerating compartment doors 20. The main door 40 may be rotatably mounted to the cabinet 10 by a hinge 401 to open/close a portion of the refrigerating compartment 12.

In addition, an opening 45 opened in a predetermined size is formed in the main door 40. The opening 45 may be formed such that the storage space of the cabinet 10 is exposed to the outside in a state in which the main door 40 is closed. In addition, the plurality of door baskets 100 may be mounted in the opening 45.

Thus, the user can access the door baskets 100 at a rear surface of the main door 40 by opening the main door 40. In addition, the user can access the door baskets 100 through the opening 45 by opening the sub-door 50 in the state in which the main door 40 is closed.

The sub-door 50 may be rotatably mounted at the inside of the opening 45 to open/close the opening 45. In addition, at least one portion of the sub-door 50 may be formed of a transparent material such as glass. Thus, the user can access the opening 45 by opening the sub-door 50, and simultaneously see through the inside of the opening 45 even in a state in which the sub-door 50 is closed. Therefore, the sub-door 50 may be referred to as a see-through door.

In addition, a plurality of door baskets 100 may be mounted at a rear surface of the freezing compartment door 300. Widths of the refrigerating compartment door 20 and the freezing compartment door 30 may be formed equal to each other. In this case, the door baskets 100 mounted to the refrigerating compartment door 20 and the freezing compartment door 30 may all have the same shape, and be separable from or mountable to a desired door.

Hereinafter, a structure of the door basket 100 and a mounting structure of the door basket 100 will be described. For convenience of description and understanding, a case where the door basket 100 is mounted to the freezing compartment door 30 is illustrated as an example. However, the door basket 100 may be mounted to the refrigerating compartment door 20 and the main door 40 of the refrigerating compartment door 20, and it is disclosed in advance that the door basket 100 is mountable to all refrigerator doors regardless of types of refrigerators and types of doors.

Figure 4:
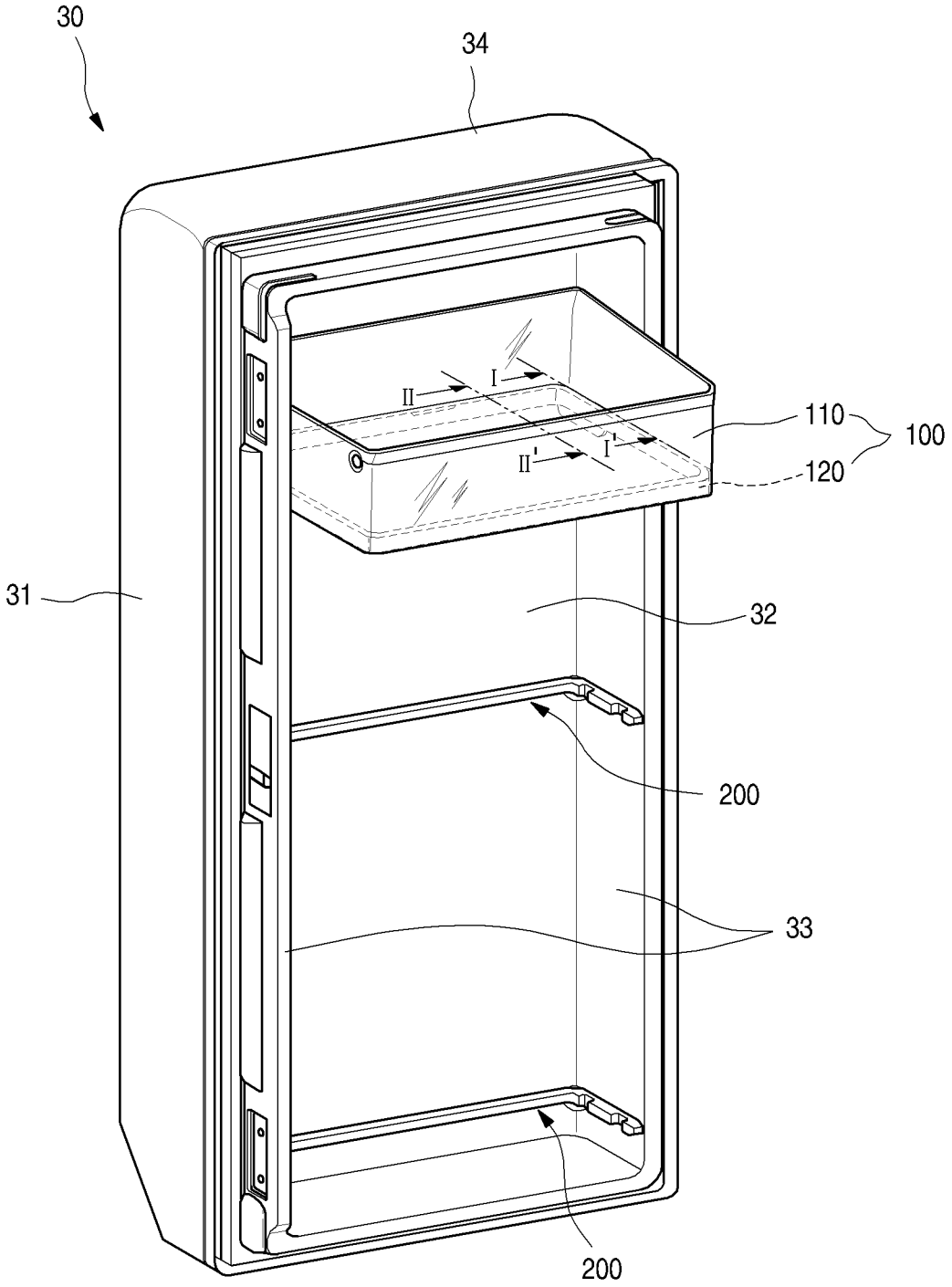
FIG. 4 is a rear perspective view of a door of the refrigerator.
Figure 5:
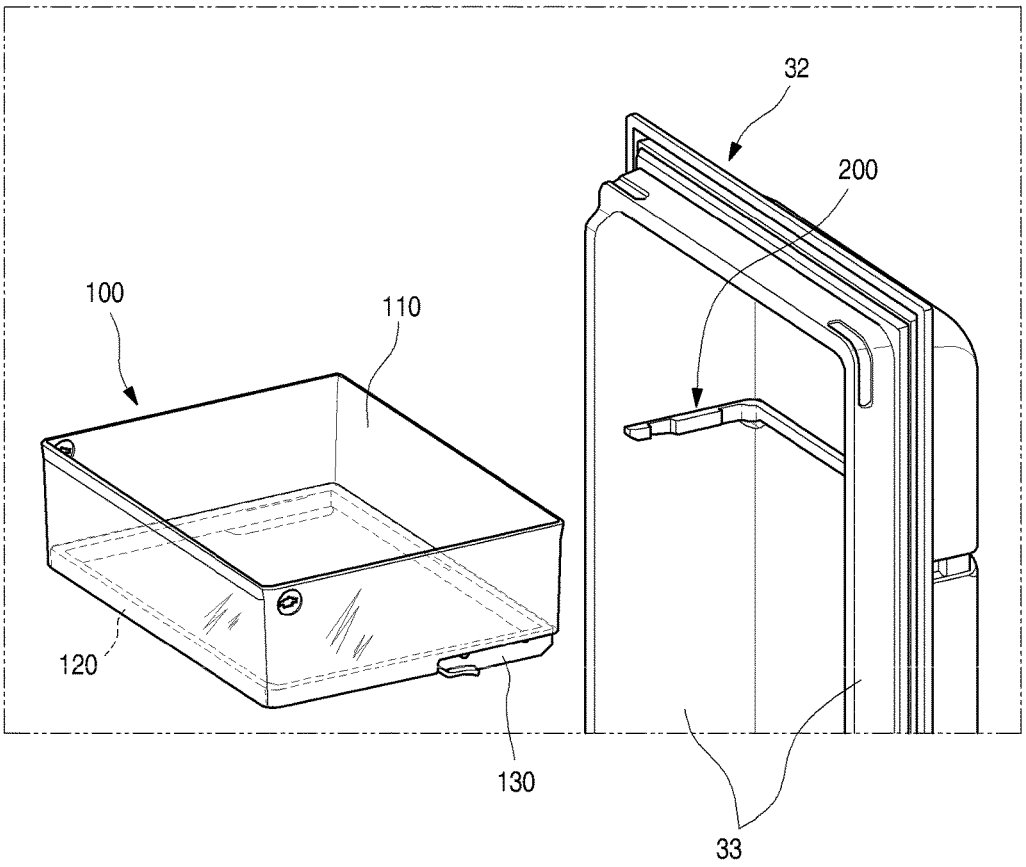
FIG. 5 is an exploded perspective view showing a coupling structure of the door and a door basket.

FIG. 4 is a rear perspective view of a door of the refrigerator. FIG. 5 is an exploded perspective view showing a coupling structure of the door and the door basket.

As shown in the drawings, the appearance shape of the freezing compartment door 30 (hereinafter, referred to as the door 30) may be formed by an out case 31, and the internal shape of the door 30 may be formed by a door liner 32. In addition, a cap deco 34 may be mounted at top and bottom ends of the door 30, and a heat insulating material (not shown) may be foamed in an internal space formed by the out case 31, the door liner 32, and the cap deco 34.

The out case 31 may be formed by bending a steel plate. If necessary, the out case 31 may be formed of various materials to form the appearance of the refrigerator 1. In addition, the door liner 32 may be injection-molded with a resin material, and a door basket 100 provides an attachable/detachable structure at a rear surface of the door 30.

That is, a door dike 33 extending along an edge of the door 30 may be formed at the door liner 32, and a mounting projection 200 may be formed at the door dike 33 such that the door basket 100 can be fixed and mounted to the door 30.

The mounting projection 200 may be formed at each of the door dikes 33 at left and right sides, and be configured to connect between the door dikes 33. In addition, the mounting projection 200 may be formed in plurality in the top-bottom direction. Thus, the user can determine a mounting position of the door 30 by mounting the door basket 100 at a desired height. A plurality of door basket 100 may be mounted to a plurality of mounting projections 200, and an appropriate storage environment may be created according to foods to be stored.

The door basket 100 may be fixed to the rear surface of the door 30 in a state in which the door basket 100 is mounted to the mounting projection 200. In addition, both left and right surfaces and the rear surface of the door basket 100 may be supported to maintain a stable mounting state.

The door basket 100 may further protrude than the door dike 33 in a state in which the door basket 100 is mounted to the door 30. The door basket 100 may protrude by a length where the door basket 100 does not interfere with storage members in the refrigerator 1 when the door 30 is closed.

The door basket 100 may include a storage part 110 and a frame part 120. The storage part 110 is used to form a storage space, and may be formed of a transparent or translucent material such that the user can see through the inside of the storage space. The frame part 120 may be formed at the bottom end circumference of the door basket 100.

Mounting parts 130 coupled to the mounting projection 200 may be formed at both side surfaces of the frame part 120, respectively, so that the door basket 100 can be mounted to the rear surface of the door 30. In addition, as the mounting projection 200 is covered by the frame part 120 when the mounting projection 200 is coupled to the mounting parts 130, the mounting projection 200 can be covered without being directly exposed to the outside or being exposed through the transparent storage part 110.

Figure 6:
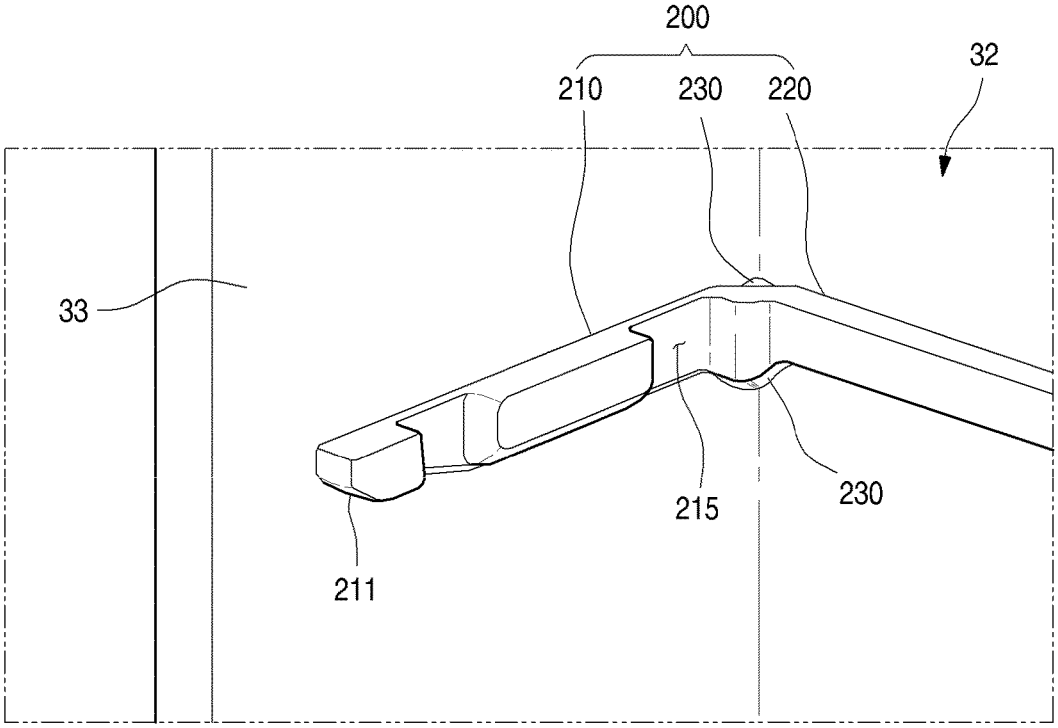
FIG. 6 is an enlarged view showing a shape of a mounting projection formed at the door.

FIG. 6 is an enlarged view showing a shape of the mounting projection formed at the door.

Referring to the drawing, the mounting projection 200 may include a pair of side surface parts 210 respectively formed at inner surfaces of the door dikes 33 at the left and right sides, and a rear surface part 220 connecting the pair of side surface parts 210.

The rear surface part 220 may be formed to cross an inner surface of the door 30, i.e., a surface in contact with a rear surface of the door 30 when the door basket 100 is mounted. In addition, as both ends of the rear surface part 220 are respectively connected to the pair of side surface parts 210, the mounting projection 200 may be entirely formed in a shape in which the mounting projection 200 crosses the inner surface of the door 30 in the lateral direction.

The rear surface part 220 is not formed to cross the entire inner surface of the door 30 but may be formed to respectively extend from both ends of the pair of side surface parts 210 while being spaced apart from each other. That is, the mounting projection 200 may be formed at both corner portions of the inside of the door 30.

In addition, a molding part 230 may be formed at a corner portion at which the side surface part 210 and the rear surface part 220 are connected to each other. The molding part 230 extends such that a corner portion of the mounting projection 200 and a corner portion of the door liner 32 are connected to each other with a gentle inclination or round. Thus, it is possible to prevent the generation of a wrinkle or the occurrence of a defect at the corner portion of the door liner 32 when the door liner 32 is vacuum molded.

The side surface part 210 extends forward at a rear end of the door dike 33, and may extend horizontally to the bottom surface of the door basket 100. Also, the side surface part 210 may extend up to a protruding end portion of the door dike 33 or one side adjacent to the end portion at the rear end of the door dike 33.

An inclined surface 211 may be formed at a bottom surface of the front end of the side surface part 210. Therefore, the side surface part 210 may be formed such that its vertical thickness increases as approaching the rear end from the front end in the region of the inclined surface 211.

A first fixing groove 213 may be formed in the side surface part 210. The first fixing groove 213 may be formed recessed in a direction perpendicular to the extending direction of the side surface part 210. The first fixing groove 213 may be formed opened in the top-bottom direction such that a first fixing projection 133 which will be described later can be inserted thereinto.

In addition, a second fixing groove 215 may be further formed at a rear of the first fixing groove 213. The second fixing groove 215 is located at a rear distant from the first fixing groove 213, and may be formed such that a second fixing projection 134 which will be described later can be inserted thereinto. The first fixing groove 213 and the second fixing groove 215 are formed to enable the first fixing projection 133 and the second fixing projection 134 to be held and restricted therein, respectively. The first fixing groove 213 and the second fixing groove 215 may be formed in a shape recessed downward from the top surface of the side surface part 210 or a shape vertically penetrated into the side surface part 210.

Figure 7:
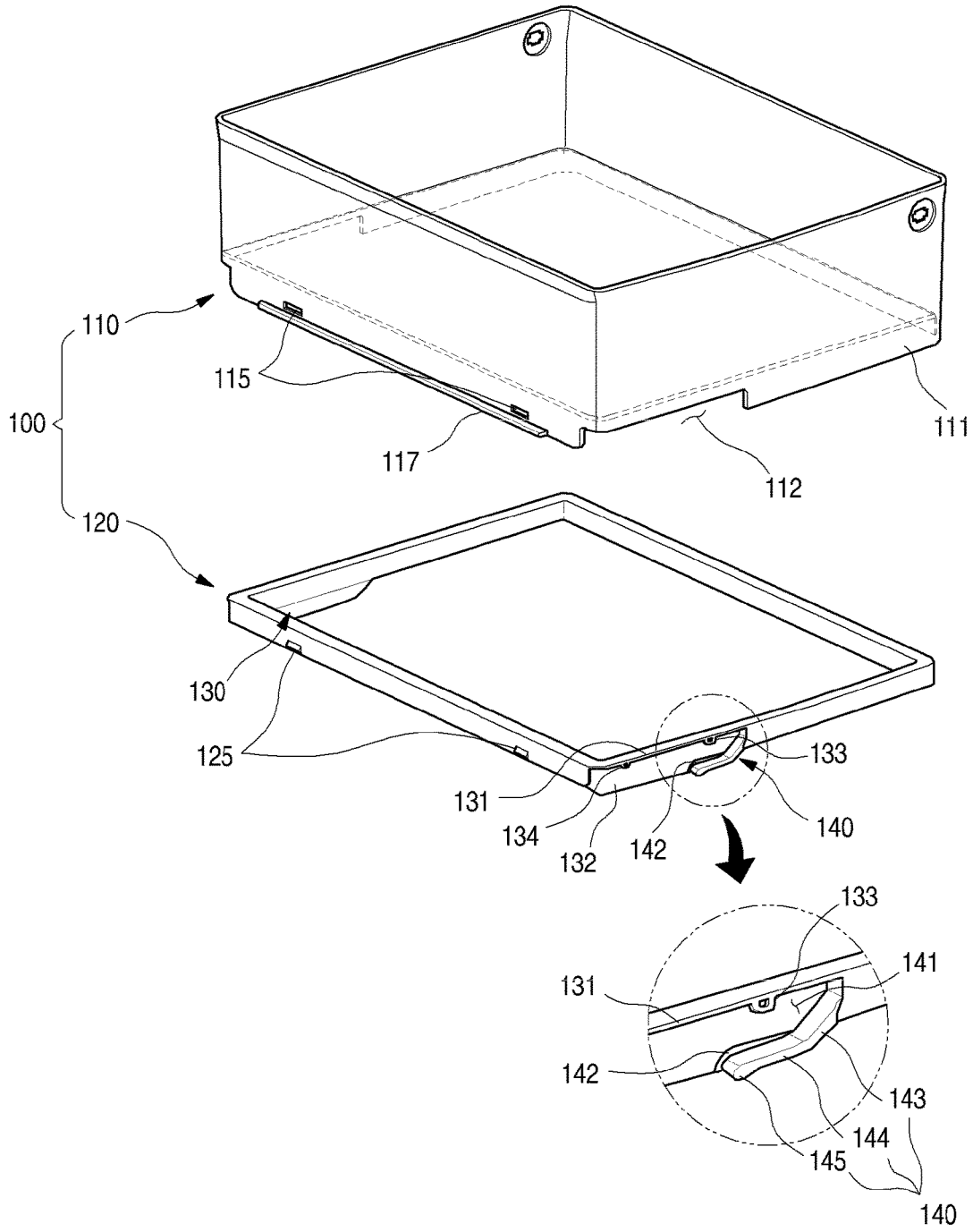
FIG. 7 is an exploded perspective view of the door basket, viewed from the top.
Figure 8:
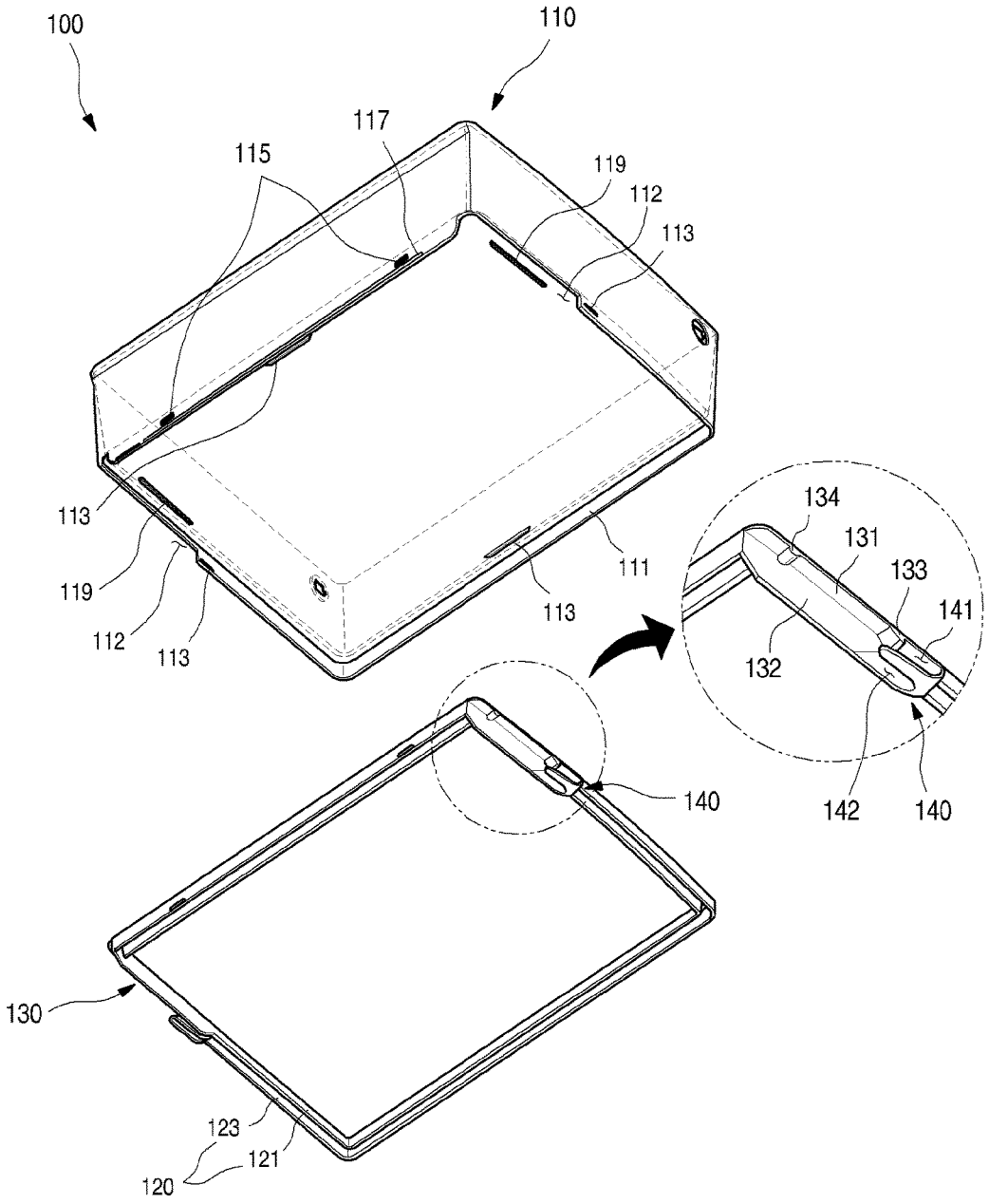
FIG. 8 is an exploded perspective view of the door basket, viewed from the bottom.

FIG. 7 is an exploded perspective view of the door basket, viewed from the top. FIG. 8 is an exploded perspective view of the door basket, viewed from the bottom.

As shown in the drawings, the door basket 100 may include the storage part 110 and the frame part 120 inserted into the bottom end circumference of the storage part 110.

The storage part 110 may be formed in the shape of a quadrangular basket of which top surface is opened. The storage part 110 is not limited to the completely transparent form. A lateral width of the storage part 110 may be formed to correspond to a width between the pair of door dikes 33, and a front-rear width of the storage part 110 may be formed longer than a protruding height of the door dike 33.

A rim 111 that enables the frame part 120 to be mounted thereto may be formed at a bottom surface of the storage part 110. The rim 111 may be formed along the circumference of the bottom surface of the storage part 110, and cut-out parts 112 may be formed at latter half portions of both left and right side surfaces at which the mounting parts 130 which will be described later are formed, respectively, so that the rim 111 is not formed.

A height of the rim 111 may be formed equal to or slightly higher than a thickness of the frame part 120. Therefore, the frame part 120 is located at the bottom surface of the storage part 110, and may be accommodated in the rim 111.

In addition, a restricting projection 113 protruding toward an inner space of the rim 111 may be formed at a bottom end of the rim 111. The restricting projection 113 restricts a bottom end of the frame part 120 when the frame part 120 is mounted in the rim 111, so that the frame part 120 is not separated but maintains a fixed state. The restricting projection 113 may be formed at left and right sides corresponding to the mounting part 130 to which a force is applied when the door basket 100 is mounted or separated. The restricting projection 113 may be formed at a rear that is not exposed to the outside when the door basket 100 is mounted. Also, the restricting projection 113 may be formed in plurality, if necessary.

In addition, a coupling groove may be formed in an inner surface of the rim 111, corresponding to a rear surface (a left surface in FIG. 7) of the door basket 100. The coupling groove 115 is formed at left and right sides, and may be formed in plurality, if necessary. A coupling projection 125 protruding at a rear surface of the frame part 120 is inserted into the coupling groove 115, and the coupling groove 115 enables the frame part 115 to maintain a more firmly coupled state. Since the coupling groove 115 and the coupling projection 125 are located at the rear surface of the door basket 100, the coupling groove 115 and the coupling projection 125 are not exposed to the outside when the door basket 100 is mounted.

In addition, a supporting rib 117 protruding rearward may be formed at a bottom end of the rim 111, corresponding to the rear surface of the door basket 100. The supporting rib 117 may protrude to be in contact with the bottom surface of the rear surface part 220 of the mounting projection 200 when the door basket 100 is mounted. Thus, when a load is applied to the door basket 100, the supporting rib 117 is held and restricted to the rear surface part 220 to fix and support the rear end of the door basket 100. Particularly, the door basket 100 can maintain a stable fixing and mounting state even when a momentum is applied as a load is applied at a first half portion of the door basket 100.

A restricting rib 119 may be formed to protrude downward at the bottom surface of the storage part 110. The restricting rib 119 may be formed to extend long at a position at which the restricting rib 119 is spaced apart from the rim 111 by a distance corresponding to a width of the frame part 120. The restricting rib 119 may be disposed to be spaced apart from the rim 111 at the front, rear, left and right surfaces of the door basket 100. The restricting rib 119 may support the frame part 120 at the inside of the frame part 120.

If the frame part 120 is mounted to the bottom surface of the storage part 110, an outer surface of the frame part 120 may be primarily fixed by being adhered closely to an inner surface of the rim 111, secondarily fixed by the restricting projection 113 not to be separated downward, tertiarily fixed by the coupling groove 115 and the coupling projection 125, and quaternarily fixed by the restricting rib 119. Thus, the frame part 120 to which a load is intensively applied in the mounting of the door basket 100 is not separated from the storage part 110 but can maintain a state in which the frame part 120 and the storage part 110 are coupled to each other.

The frame part 120 may be formed in a shape corresponding to the bottom surface of the storage part 110. The frame part 120 may be formed along the circumference of the bottom surface of the storage part 110. The frame part 120 may be injection-molded with an opaque material. If necessary, a surface treatment may be performed on the injection-molded surface using any one method among metal deposition, painting, printing, and coating to have an opaque colored structure. The frame part 120 may be formed using another method instead of the injection molding. The frame part 120 may be formed of another material such as metal except plastic resin. In this case, the frame part 120 may be formed of a material having a higher strength than the storage part 110. That is, the storage part 110 may be formed of a material that enables the user to see through the inside of the storage part 110 and improve the appearance of the storage part 110, and the frame part 120 may be formed of a material having a strength that enables the door basket 100 to maintain a stable and firm mounting.

Thus, the frame part 120 can form an opaque or colored appearance of the bottom end circumference of the door basket 100 in a state in which the frame part 120 is mounted to the inside of the rim 111, and form an opaque region unlike a space in which foods are stored.

Meanwhile, the frame part 120 may have a structure molded separately from the storage part 110 to be coupled to the storage part 110. However, if necessary, the frame part 120 may be formed through double injection in molding of the storage part 110. Alternatively, the frame part 120 may be formed by opaquely processing the bottom end of the storage part 110 using any one method among metal deposition, painting, printing, and coating after the storage part 110 is molded.

The frame part 120 may be formed in the shape of a quadrangular frame, and include rib-shaped inner and outer parts 121 and 123 that are entirely spaced apart from each other. Top ends of the inner and outer parts 121 and 123 are connected to each other to form a top surface, and are in contact with the bottom surface of the storage part 110. In addition, the outer part 123 may be adhered closely to the rim 111.

The coupling projection 125 may be formed to protrude at a portion that forms a rear surface of the outer part 123. In addition, a bottom end of the outer part 123 may be held and restricted by the restricting projection 113 in a state in which the frame part 120 is mounted to the storage part 110.

The mounting parts 130 may be formed at both the side surfaces of the frame part 120, respectively. The mounting parts 130 may be formed latter half portions of both the side surfaces of the door basket 100, respectively. The mounting parts 130 may be formed in a corresponding shape such that the mounting projection 200 can be accommodated therein.

The mounting part 130 may include a top surface 131 and a side surface 131. The top surface 131 forms a top surface of the frame part 120 and a top surface of the mounting part 130. In addition, the first fixing projection 133 and the second fixing projection 134 may protrude downward at the top surface of the mounting part 130. The first fixing projection 133 and the second fixing projection 134 may be formed at positions corresponding to the first fixing groove 213 and the second fixing groove 215, respectively.

Front surfaces 133*a* and 134*a* and rear surfaces 133*b* and 134*b* of the first fixing projection 133 and the second fixing projection 134 may be formed inclined, and the rear surfaces 133*b* and 134*b* may have a more gentle inclination than the front surfaces 133*a* and 134*a*. Thus, when the door basket 100 is mounted, the front end and top surface of the side surface part 210 are in contact with the rear surfaces 133*b* and 134*b* when the front end and top surface of the side surface part 210 are in contact with the first fixing projection 133 and the second fixing projection 134, so that the door basket 100 can be softly mounted.

In addition, if necessary, the front surfaces 133*a* and 134*a* may be formed to be at a right angle to the bottom of the door basket 100 or to have an inclination corresponding to the right angle. Thus, when the door basket 100 is completely mounted, the front surfaces of the first fixing projection 133 and the second fixing projection 134 are restricted in the first fixing groove 213 and the second fixing groove 215, so that the door basket 100 cannot be easily separated.

The side surface 132 may correspond to a portion of the inner part 121, and be formed to extend downward of the height of the rim 111. The side surface 132 of the mounting part 130 may be formed to cover the entire side surface part 210 of the mounting projection 200 in a state in which the door basket 100 is mounted to the door 30. That is, the side surface 132 of the mounting part 130 may extend downward of the bottom end of the side surface part 210 to cover side surface part 210.

An elastic part 140 may be formed at the front end of the side surface 132. The elastic part 140 may be formed to extend along the side surface 132 at the front end of the mounting part 130. The elastic part 140 may be formed in a plate shape having a predetermined width to be in contact with the bottom surface of the side surface part 210.

The elastic part 140 may extend to have a predetermined length such that the side surface part 210 can be inserted and accommodated therein. The elastic part 140 may form a guide groove 141 spaced apart from the top surface of the mounting part 130 to allow the side surface part 210 to be inserted thereinto.

In addition, the elastic part 140 may be formed to correspond to the shape of a first half portion of the side surface part 210 such that the side surface part 210 and the elastic part 140 are coupled in a state in which the first half portion of the side surface part 210 and the guide groove 141 are completely adhered closely to each other when the first half portion of the side surface part 210 is inserted into the guide groove 141.

The front end of the elastic part 140 may be fixed to the mounting part 130, and a side end of the elastic part 140 may be spaced part from the side surface 132 of the mounting part 130. That is, a slit 142 may be formed between the side end of the elastic part 140 and the side surface of the mounting part 130. Thus, the elastic part 140 can be easily elastically deformed based on the fixed front end.

The elastic part 140 may include an inclination part 143 fixed to the mounting part 130, the inclination part 143 having an inclination corresponding to the inclined surface 211, an extension part 144 extending at the inclination part 143 to be in contact with the bottom surface of the side surface part 210, and an entrance part 145 formed inclined at an end portion of the extension part 144 to allow the entrance of the guide groove 141 to be gradually widened.

In the mounting part, the first fixing projection 133 is located above the elastic part 140, particularly, the extending part 144. Thus, in the state in which the door basket 100 is mounted, the side surface part 210 at the front of the first fixing groove 213 can be fixed at the inside of a space formed by the first fixing projection 133 and the elastic part 140. In addition, the second fixing projection 134 can be fixed at the inside of the second fixing groove 215.

Figure 9:
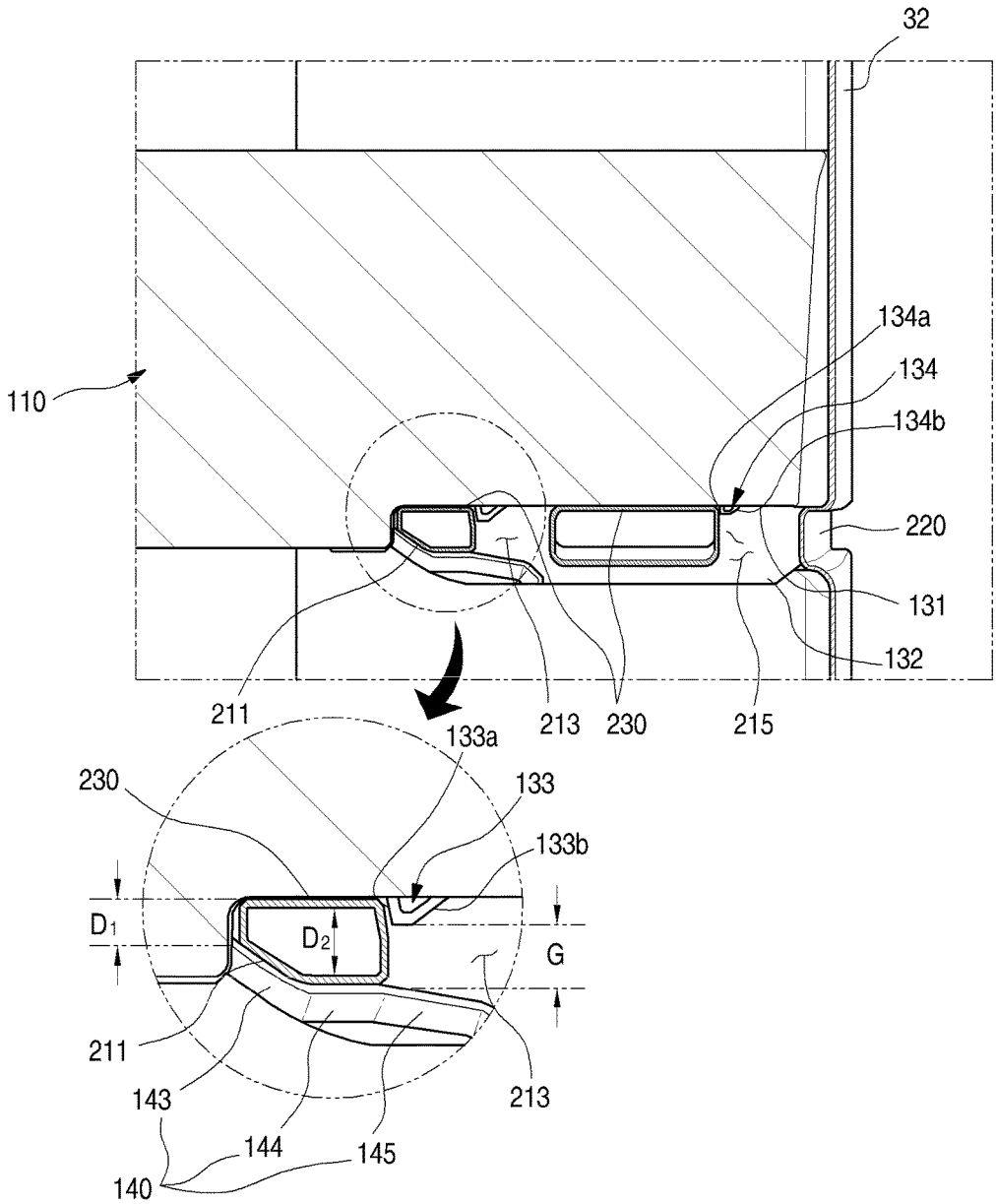
FIG. 9 is a sectional view taken along line I-I' of FIG. 4.
Figure 10:
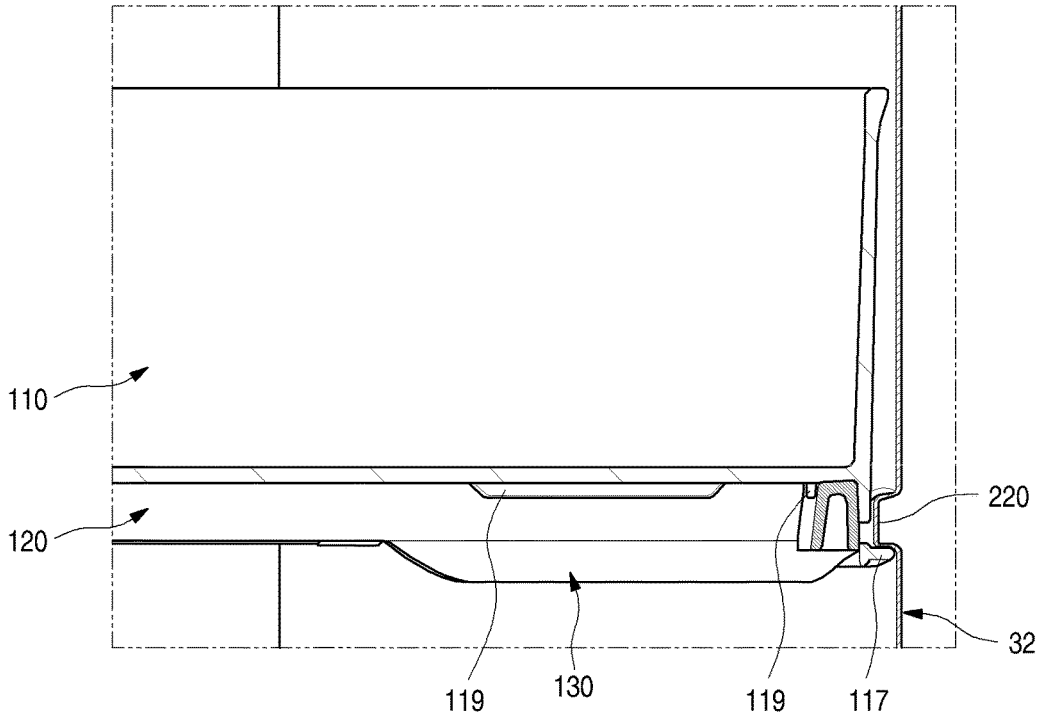
FIG. 10 is a sectional view taken along line II-II' of FIG. 4.

FIG. 9 is a sectional view taken along line I-I' of FIG. 4. FIG. 10 is a sectional view taken along line II-II' of FIG. 4.

A coupling structure of the mounting projection 200 and the mounting part 130 in the state in which the door basket 100 is mounted to the door 30 will be described with reference to the drawings.

In the state in which the door basket 100 is mounted to the door 30, the side surface part 210 is located at the inside of the mounting part 130 as shown in FIG. 9. The side surface part 210 is completely covered by the side surface 132 of the mounting part 130.

In addition, as shown in FIG. 10, the rear surface part 220 is supported by the supporting rib 117 while being in contact with the supporting rib 117. That is, both the side surface and the bottom end of the door basket 100 are fixed to the rear surface of the door 30, so that a load applied to the door basket 100 can be stably supported.

At this time, the side surface part 210 extends in the front-rear direction, to effectively support a load applied in the top-bottom direction. In addition, the rear surface part 220 is restricted by the supporting rib 117, to support a momentum applied to the door basket 100. Thus, the large-capacity door basket 100 can be stably mounted and used.

Meanwhile, in the mounting part 130, the first fixing projection 133 is located vertically above the elastic part 140. In addition, a portion of the side surface part 210, which is formed at the front of the first fixing groove 213, may be accommodated in an inner space between the first fixing project 133 and the guide groove 141.

At this time, the inclined surface 211 and the bottom surface of the side surface part 210 are adhered closely to the elastic part 140, and the top surface of the side surface part 210 is adhered closely to the top surface 131 of the mounting part 130. In addition, since the front end of the first fixing groove 213 is restricted by the first fixing projection 133, the side surface part 210 at the front of the first fixing groove 213 is entirely fixed to be completely press-fitted into the guide groove 141.

A gap G between the bottom end of the first fixing projection 133 and the top end of the elastic part 140 is formed greater than a thickness $D_1$ of the front end of the side surface part 210. Thus, when the side surface part 210 is inserted into the guide groove 141, the front end of the side surface part 210 can be smoothly inserted between the first fixing projection 133 and the elastic part 140.

In addition, the gap G between the bottom end of the first fixing projection 133 and the top end of the elastic part 140 is formed smaller than a thickness $D_2$ of the side surface part 210 at the rear end of the inclined surface 211. Thus, when the side surface part 210 is inserted into the guide groove 141, the elastic part 140 moves along the inclined surface 211. At this time, as the elastic part 140 is elastically deformed, the gap G between the first fixing projection 133 and the elastic part 140 is gradually increased.

If the side surface part 210 is completely inserted, the first fixing projection 133 is located at the inside of the first fixing groove 213. At this time, the elastic part 140 is returned to the original position, and the first half portion of the side surface part 210 is fixed at the inside of the guide groove 141. Here, the thickness $D_2$ of the side surface part 210 may be formed slightly thicker than a vertical height at the inside of the guide groove 141. In this case, the side surface part 210 may be in a state in which the side surface part 210 is press-fixed by the elastic part 140, and maintain a firm coupling state as the side surface part 210 is adhered closely to the elastic part 140.

In the state in which the door basket 100 is completely mounted, the second fixing projection 134 is further inserted into the second fixing groove 215, so that the door basket 100 can be more stably supported. That is, in addition to the structure in which the door basket 100 is fixed by the side surface part 210 and the elastic part 140, there is provided a structure in which the second fixing groove 215 and the second fixing projection 134 are held and restricted at the rear of the first fixing groove 213, so that the latter half portion of the door basket 100 can be further fixed.

Hereinafter, a mounting process of the door basket having the above-described structure according to the embodiment will be described.

Figure 11A:
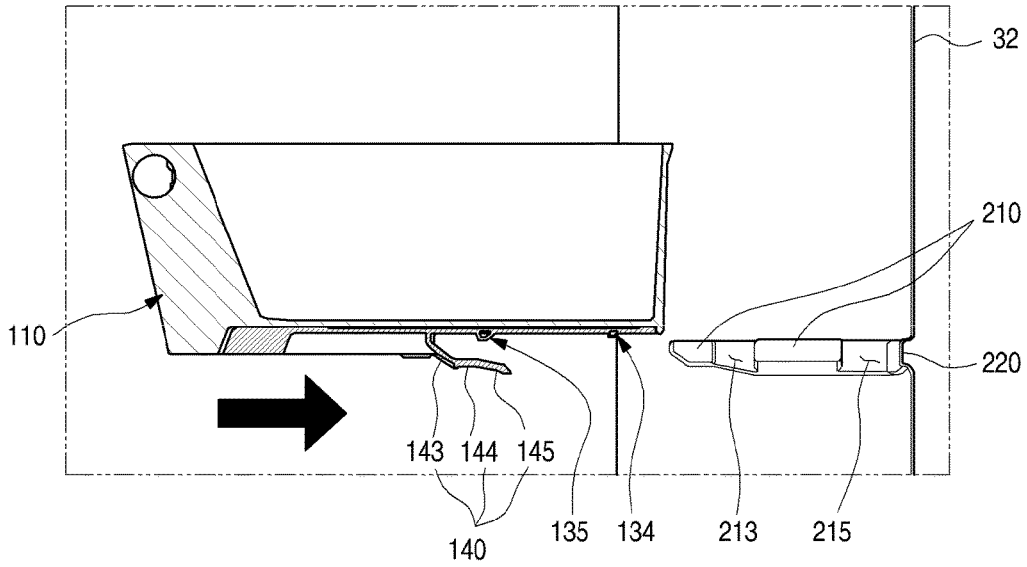
FIGS. 11A to 11C are views sequentially showing a mounting process of the door basket.
Figure 11B:
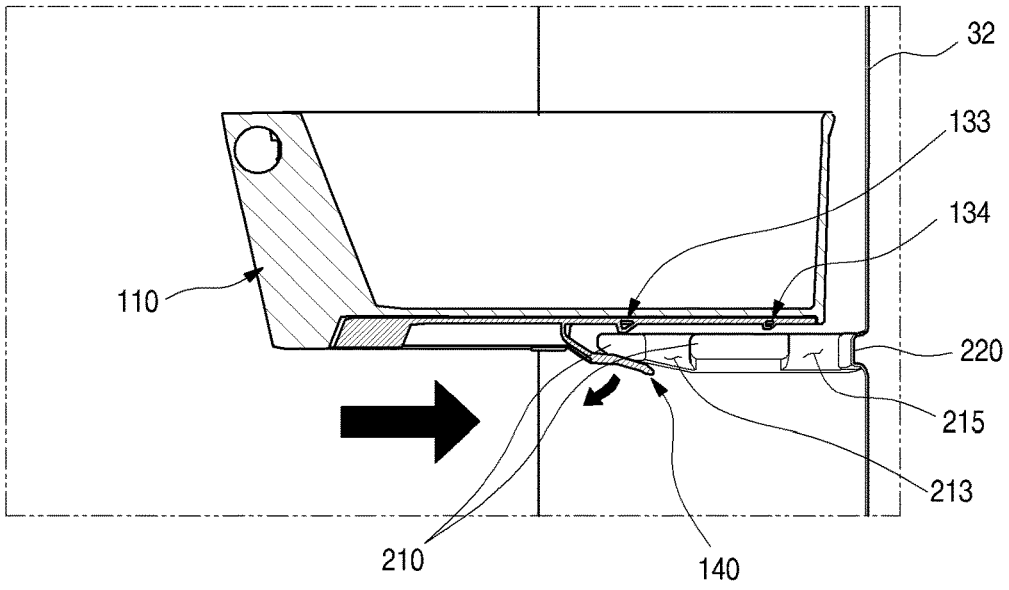
Figure 11C:
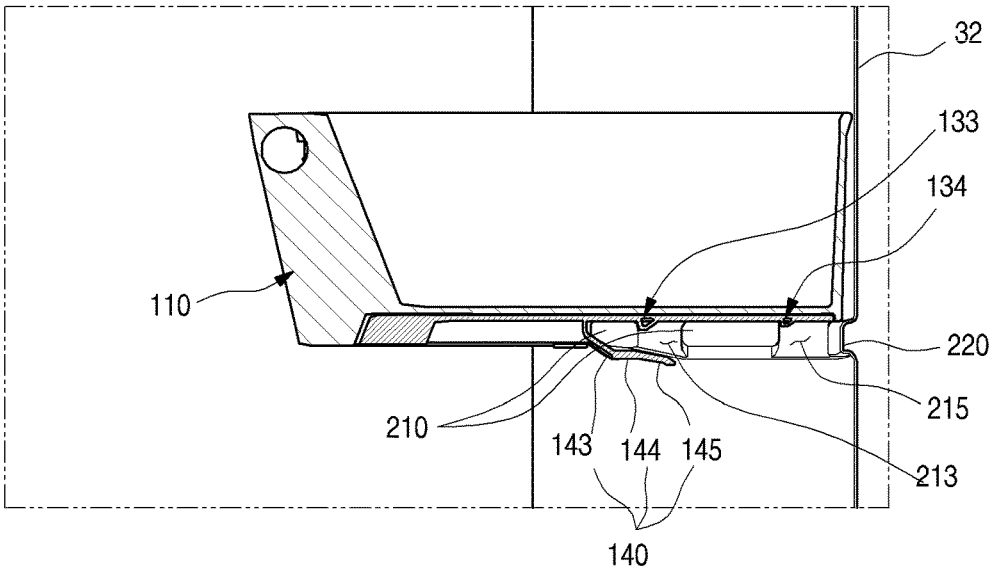

FIGS. 11A to 11C are views sequentially showing a mounting process of the door basket.

As shown in the drawings, in order to mount the door basket 100, the door basket 100 is placed at a height corresponding to the position of the mounting projection 200 as shown in FIG. 11A.

In this state, the gap G between the first fixing projection 133 and the elastic part 140 becomes narrower than the thickness $D_2$ of the side surface part 210 at the rear end of the inclined surface 211 in a state in which any external force is not applied.

If the door basket 100 is pushed rearward at a height corresponding to the height of the mounting projection 200, the side surface part 210 is inserted into the entrance of the guide groove 141.

At this time, the entrance part 145 of the elastic part 140 is in contact with the inclined surface 211 of the side surface part 210, and the front end of the side surface part 210 is inserted between the first fixing projection 133 and the elastic part 140. In this state, if the door basket 100 is moved further rearward, the inclined surface 211 is moved in a state in which the inclined surface 211 is in contact with the extension part 144. As the elastic part 140 is elastically deformed downward, the gap G between the first fixing projection 133 and the elastic part 140 is gradually widened to be in a state as shown in FIG. 11B.

In addition, if the door basket 100 is completely pushed to the rear surface of the door 30, the front end of the side surface part 210 is completely inserted into the guide groove 141 to be in a state as shown in FIG. 11C.

In this case, the side surface part 210 is completely adhered closely to the inside of the guide groove 141. That is, the inclined surface 211 is adhered closely to the inclination part 143, the bottom surface of the side surface part 210 is adhered closely to the extension part 144, and the top surface of the side surface part 210 is adhered closely to the top surface 131 of the mounting part 130. In addition, the first fixing projection 133 is adhered closely to the front surface of the first fixing groove 213 in a state in which the first fixing projection 133 is inserted into the first fixing groove 213. At this time, the elastic part 140 is elastically returned to the original position, and thus the gap G between the first fixing projection 133 and the elastic part 140 becomes smaller than the thickness $D_2$ of the side surface part 210 at the rear end of the inclined surface 211.

In the state in which the door basket 100 is completely mounted, the door basket 100 is not pulled out forward by restriction of the first fixing projection 133 and the second fixing projection 134, and thus a stable mounting state can be maintained even when the door 30 is rapidly rotated.

Meanwhile, in the state as shown in FIG. 11C, the supporting rib 117 at the rear end of the door basket 100 is in contact with the bottom surface of the rear surface part 220. Thus, the rear end of the door basket 100 is held and restricted to maintain a stable mounting state without moving even when a momentum is applied.

When the position of the door basket 100 is to be changed or when the door basket 100 is to be separated, the door basket 100 can be separated by being pulled with a force to a degree where the first fixing projection 133 and the second fixing projection 134 are respectively escaped from the first fixing groove 213 and the second fixing groove 215 as the elastic part 140 is elastically deformed.

Although some embodiments of the present disclosure are described for illustrative purposes, it will be apparent to those skilled in the art that various modifications and changes can be made thereto within the scope of the disclosure without departing from the essential features of the disclosure.

Accordingly, the aforementioned embodiments should be construed not to limit the technical spirit of the present disclosure but to be provided for illustrative purposes so that those skilled in the art can fully understand the spirit of the present disclosure.

The scope of the present disclosure should not be limited to the aforementioned embodiments but defined by appended claims. The technical spirit within the scope substantially identical with the scope of the present disclosure will be considered to fall in the scope of the present disclosure defined by the appended claims.

What is claimed is:

1. A refrigerator comprising:

a cabinet having a storage space formed therein;

a door mounted to the cabinet to open/close the storage space;

mounting projections formed at a rear surface of the door; and a door basket attachably/detachably mounted at the rear surface of the door by the mounting projections, wherein the door basket includes:

a storage part formed of a transparent material to allow the inside thereof to be seen, the storage part forming a space in which foods are stored; and a frame part formed at a bottom end of the storage part, the frame part being coupled to the mounting projections to support the door basket and simultaneously shield the mounting projections at the outside, wherein the door includes door dikes protruding at both left and right sides of the door and the mounting projections are formed at the door dikes, each mounting projection extending in a direction horizontal to a bottom surface of the door basket, and wherein the frame part includes:

mounting parts respectively extending downward at both side surfaces of the frame part corresponding to positions of inner surfaces of the mounting projections to cover the mounting projections in a lateral direction, and a top surface extending outward at a top end of the mounting parts to be mounted on a top surface of the mounting projections.

2. The refrigerator of claim 1, wherein the frame part is formed of an opaque material, and is mounted at a bottom surface of the storage part.

3. The refrigerator of claim 1, wherein the frame part allows the bottom end of the storage part to be opaque through any one of metal deposition, painting, printing, and coating.

4. The refrigerator of claim 1, wherein the mounting projections are integrally formed in molding of a door liner that forms the rear surface of the door.

5. The refrigerator of claim 1, wherein the mounting projections include:

side surface parts respectively formed at inner surfaces of the door dikes protruding at both edges of the rear surface of the door; and a rear surface part connecting between both the side surface parts.

6. The refrigerator of claim 5, wherein a supporting rib that protrudes rearward and is held and restricted to a bottom end of the rear surface part is formed at a rear surface of the door basket.

7. The refrigerator of claim 1, wherein an inclined surface is formed at a front end of each mounting projection such that a thickness of each mounting projection is thickened as approaching a rear end of each mounting projection, wherein a fixing groove recessed or penetrated in a top-bottom direction is formed at the rear of the inclined surface.

8. The refrigerator of claim 7, wherein a guide groove opened rearward such that the mounting projections are inserted thereinto is formed in the frame part, wherein an elastic part that is elastically deformed in the top-bottom direction while being in contact with the mounting projections is formed at a bottom surface of the guide groove.

9. The refrigerator of claim 8, wherein the fixing projection extending downward is formed above the elastic part, and a gap between the fixing projection and the elastic part is formed narrower than the thickness of the mounting projections, wherein the fixing projection is formed at a position at which the fixing groove is inserted in a state in which the door basket is mounted.

10. The refrigerator of claim 9, wherein each of the fixing projection and the fixing groove is formed in plurality spaced apart from each other in an insertion direction of the door basket.

11. The refrigerator of claim 8, wherein a slit is formed between the mounting parts and the elastic part to facilitate elastic deformation of the elastic part.

12. The refrigerator of claim 11, wherein the elastic part includes:

an inclination part connected to the frame part, the inclination part having an inclination corresponding to the inclined surface;

an extension part extending from the inclination part, the extension part being in contact with a bottom surface of the mounting projections; and an entrance part extending from the extension part to form a spacing space with the fixing projection, wherein the spacing space is greater than a thickness of the front end of the inclined surface and smaller than a thickness of the rear end of the inclined surface.

13. The refrigerator of claim 8, wherein the elastic part extends rearward of the fixing projection, and is formed with a vertical gap narrower than the thickness of the mounting projections to press-fix the mounting projections in the mounting of the door basket.

14. The refrigerator of claim 1, wherein a rim extending to accommodate the frame part is formed along a circumference of the bottom end of the storage part.

15. The refrigerator of claim 14, wherein a fixing projection coupled to the mounting projections is formed at the frame part, and a mounting part is formed to cover the mounting projections, wherein a cut-out part opened in a shape corresponding to a region of the mounting parts is formed at the rim corresponding to the mounting parts.

16. The refrigerator of claim 14, wherein the frame part includes:

an inner part formed in a shape of a quadrangular frame;

a rib-shaped outer part spaced apart from the inner part, the outer part being in contact with the rim; and a rib-shaped inner part spaced apart from the outer part, wherein top ends of the outer and inner parts are connected to each other, and are in contact with the bottom surface of the storage part.

17. The refrigerator of claim 16, wherein a restricting rib protruding to be in contact with an inner surface of the inner part is formed at the bottom surface of the storage part, wherein a restricting projection protruding to be in contact with a bottom end of the outer part is formed at the inside of the rim to restrict the frame part.

18. The refrigerator of claim 17, wherein the mounting parts that are coupled to the mounting projections and shield the mounting projections are formed at the inner part, wherein a portion of the outer part, which corresponds to the mounting parts, is cut out such that the mounting projections enter therethrough in the mounting of the door basket.

* * * * *